United States Patent [19]

Miller

[11] Patent Number: 4,676,219

[45] Date of Patent: Jun. 30, 1987

[54] REPEATING RUBBER BAND PISTOL

[76] Inventor: Tony Miller, 1303 E. Kenwood Ave., Anaheim, Calif. 92806

[21] Appl. No.: 906,886

[22] Filed: Sep. 15, 1986

[51] Int. Cl.[4] ..... F41B 7/02

[52] U.S. Cl. ..... 124/19; 124/48

[58] Field of Search ..... 124/48, 35 R, 19, 41

[56] References Cited

U.S. PATENT DOCUMENTS

| | | | |
|---|---|---|---|
| 2,001,267 | 5/1935 | Ross | 124/48 |
| 3,549,148 | 12/1970 | Schloss | 124/35 R |
| 3,556,072 | 1/1971 | Levin | 124/35 R |
| 3,693,609 | 9/1972 | Vodinh | 124/35 R |
| 3,757,760 | 9/1973 | Darnell | 124/35 R |

*Primary Examiner*—Richard C. Pinkham
*Assistant Examiner*—T. Brown
*Attorney, Agent, or Firm*—Ben E. Lofstedt

[57] ABSTRACT

A repeating rubber band pistol for shooting elastic band and the like, including a pistol frame with handle and a pair of support arms extending upwardly from the frame, the support arms having a pair of complementary holes therein, a hand crank with a rotary spindle thereon adapted to be mounted in the pair of support arms through the pair of holes therein and adapted to be freely movable therein, a cylindrical magazine with a plurality of radially-extending elongated arms disposed circumferentially about a centrally-arranged spindle member having a central aperture therein for mounting a plurality of stretched rubber bands thereon to hold in readiness for shooting said rubber bands, and a solid cylindrically shaped spindle mounted on the frame forwardly of the handle and the support arms and adapted to freely receive the apertured magazine thereon, whereby when a string is anchorably secured to the spindle of the hand crank and the string is secured mediately about the body of one of the stretched rubber bands and the hand crank operated, the string lifts the rubber band from its mounting causing it to be shot from the gun.

3 Claims, 7 Drawing Figures

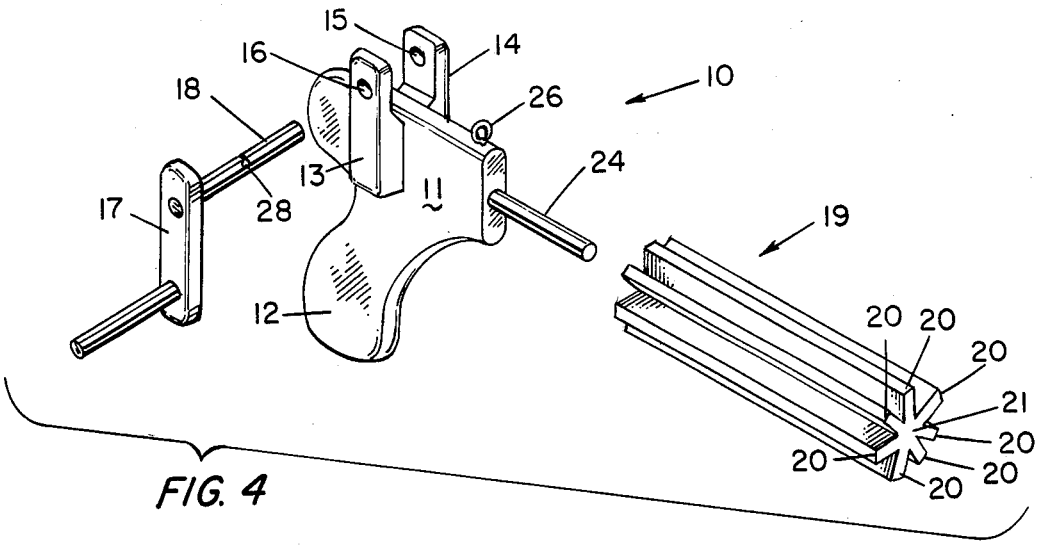
FIG. 4
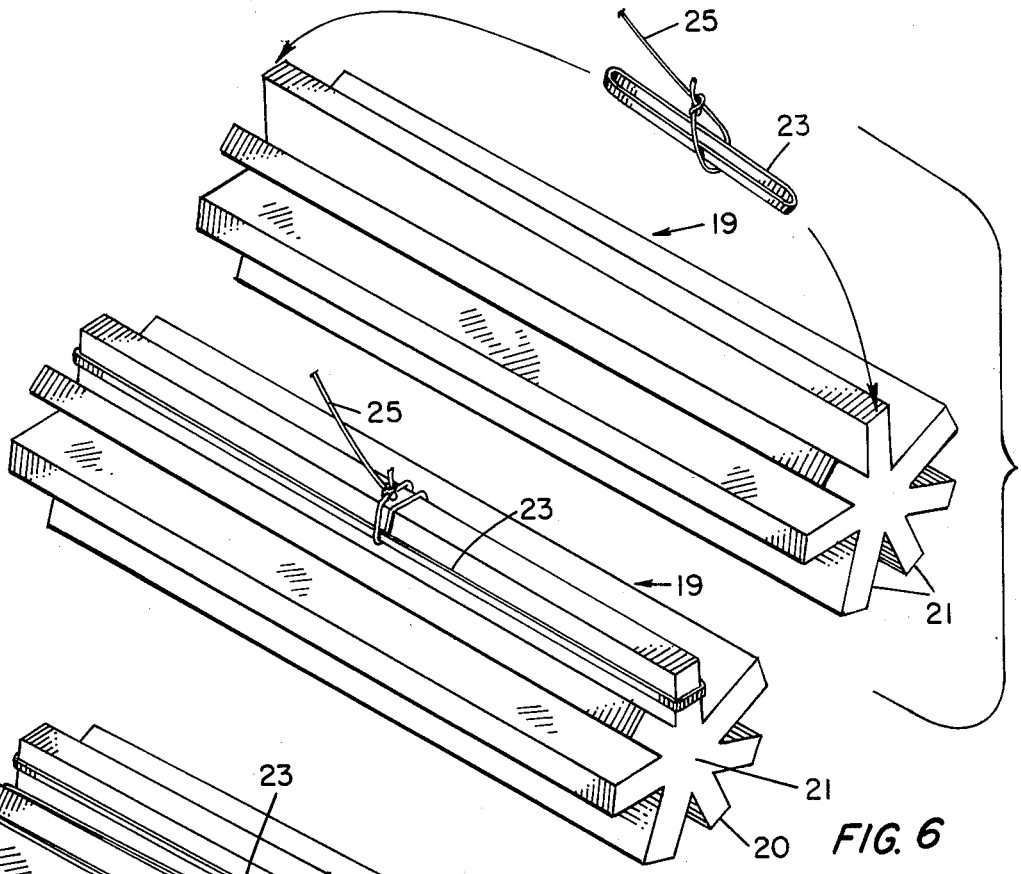
FIG. 5
FIG. 6
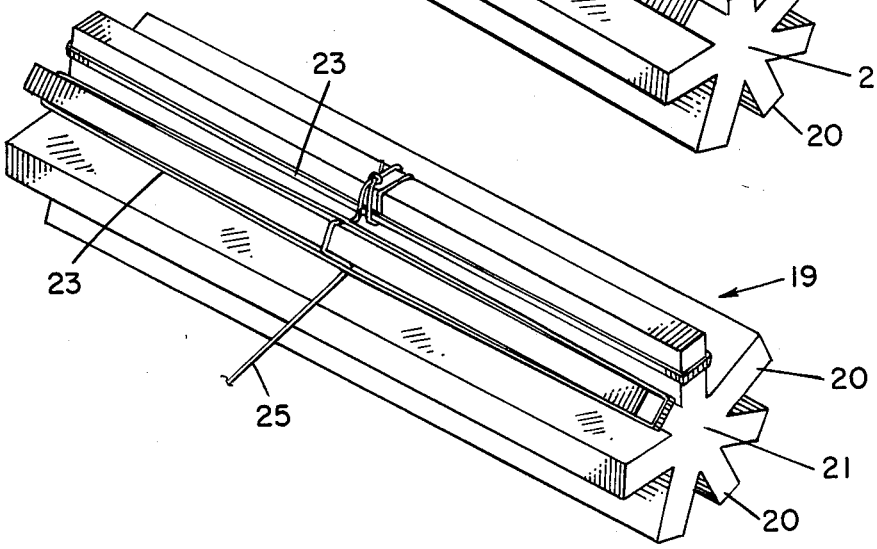
FIG. 7

REPEATING RUBBER BAND PISTOL

BACKGROUND OF THE INVENTION

1. Field of the Invention

This invention relates to a toy gun, and, more particularly to a toy revolving gun for repeatedly discharging elastic bands which have been stretched over a form.

2. Description of the Prior Art

Repeating toy weapons, adapted to discharge as missiles rubber band or similar projectiles, often suffer from difficulties encountered with the customary trigger movement in that in the "trigger pulling" stroke positive indexing impetus to the cylinder, or to the ammunition-carrying element of the gun so that the succeeding "round" can be dependably brought into firing position and be readied for the next trigger actuation. Repeating mechanisms are characterized, customarily, by a large number of small interfitting parts which have a relatively short service life.

The concept of the present invention provides a repeating toy weapon having a minimum of parts, which are easily fabricated, and in which both the trigger "pulling" or actuating motion and the return motion of the trigger, after release, are eliminated thereby allowing relatively free movement of the indexing motion impetus to the cylinder thereby assuring that rapid, dependable "firing" of the gun can be accomplished.

SUMMARY OF THE INVENTION AND OBJECTS

Fundamentally, the present invention is a repeating rubber band pistol for shooting elastic band and the like, including a pistol frame with handle and a pair of support arms extending upwardly from the frame, the support arms having a pair of complementary holes therein, a hand crank with a rotary spindle thereon adapted to be mounted in the pair of support through the pair of holes therein and adapted to be freely movable therein, a cylindrical magazine with a plurality of radially-extending elongated arms disposed circumferencially about a centrally-arranged spindle member having a central aperture therein for mounting a plurality of stretched rubber bands thereon to hold in readiness for shooting said rubber bands, and a solid cylindrically shaped spindle mounted on the frame forwardly of the handle and the support arms and adapted to freely receive the apertured magazine thereon, whereby when a string is anchorably secured to the spindle of the hand crank and the string is secured mediately about the body of one of the stretched rubber bands and the hand crank operated, the string lifts the rubber band from its mounting causing it to be shot from the gun.

One object of the present invention is to so construct the repeating rubber band pistol so that it will be extremely rugged, long-lived, and highly efficient in operation.

Another object of the instant invention is to provide a repeating rubber bandd gun wherein numerous rubber bands can be discharged consecutively from the gun in an automatic manner.

It is yet still further an important object of the within disclosed invention to provide a repeating rubber band gun of the type described herein wherein the gun can be conveniently loaded with a substantial number of rubber bands.

It is another object of the invention to provide a rubber band gun that can be loaded much more easily than heretofore.

Another object of the within invention is to eliminate the need for springs whereby the expense and possible breakage of springs is eliminated.

It is an object of this invention to provide a toy gun in which rubber rings may be projected at targets by utilizing the force of contraction of the expended rings.

Another objective of this invention is propulsion of a ring projecticle utilizing the energy stored within the projectile.

Other and further objects and advantages of the present invention will be apparent from the following detailed description, drawings and claims, the scope of the invention not being limited to the drawings themselves as the drawings are only for the purpose of illustrating a way in which the principles of the invention can be applied.

Other embodiments of the invention utilizing the same or equivalent principles may be used and structural changes may be made as desired by those skilled in the art without departing from the present invention and the purview of the appended claims.

With these and other objects in view, my invention consists in the construction, arrangement and combination of the various parts of my gun, whereby the objects contemplated are attained, as hereinafter more fully set forth, pointed out in the appended claims, and illustrated in the accompanying drawings, in which:

BRIEF DESCRIPTION OF THE DRAWINGS

FIG. 4 is an exploded assembly view of the instant invention shown in perspective form.

FIG. 5 depicts the rubber band holding magazine immediately prior to securing the initial rubber band thereon and the looped string which causes the rubber band to be released from the magazine.

FIG. 6 depicts the rubber band holding magazine immediately following the "loading" or securing the stretched initial rubber band thereon and the looped string.

FIG. 7 depicts the rubber band holding magazine as shown in FIG. 6 with a second rubber band stretched and installed in the magazine with the string looped thereinunder.

Figure 1:
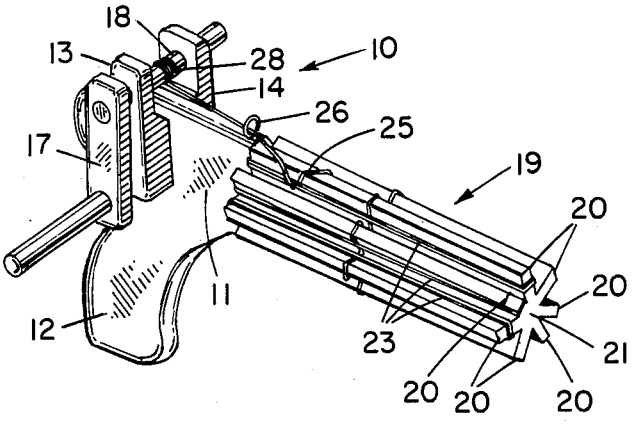
FIG. 1 is an overall perspective view of the repeating rubber band gun which is my invention which depicts said gun in assembled form.

DESCRIPTION OF THE PREFERRED EMBODIMENT:

With continued reference to all of the drawings herein, and with special emphasis now on FIG. 1, there is shown in an assembly view form the present invention referred to herein as a repeating rubber band pistol for shooting elastic band and the like and generally shown at 10. The pistol 10 includes a frame 11 with a handle 12 and a pair of support arms 13, 14 secured to the frame 11 and extend upwardly from the frame 11. The support arms 13, 14 have a pair of complementary holes 15, 16 therein. A hand crank 17 with a rotary spindle 18 thereon which is adapted to be mounted in the pair of holes 15, 16 in the support arms 13, 14 and wherein the spindle 18 is adapted to be freely movable therein is also provided. A cylindrical magazine is generally shown at 19 includes a plurality of radially-extending elongated arms 20 disposed circumferencially about a centrally-arranged spindle member 21, the spindle member 21 having a central aperture 22 therein for mounting a plurality of stretched rubber bands 23 thereon to hold in readiness for shooting said rubber bands 23, and a solid cylindrically shaped spindle 24 mounted to the frame 11 forwardly of the handle 12 and the support arms 13, 14 and which is adapted to freely receive the apertured spindle member 21 of the magazine 19 thereon, whereby when the string 25 is anchorably secured to the spindle 18 of the hand crank 17 and the string 25 is secured mediately about the body of one of the stretched rubber bands 23 and the hand crank 17 operated, the string 25 lifts the rubber band 23 from its mounting causing it to be shot from the gun or pistol 10.

Further, in order to maintain the proper alignment of the string 25 between the frame 11 and the magazine 19, there is provided an eyelet 26 mounted to the frame 11 which guides the string 25 during the operation of the of the repeating pistol 10.

Turning now to FIG. 4, there is shown an exploded assembly view of the present invention 10 depicting the relationship of all of the various parts thereof and how such are assembled.

Figure 2:
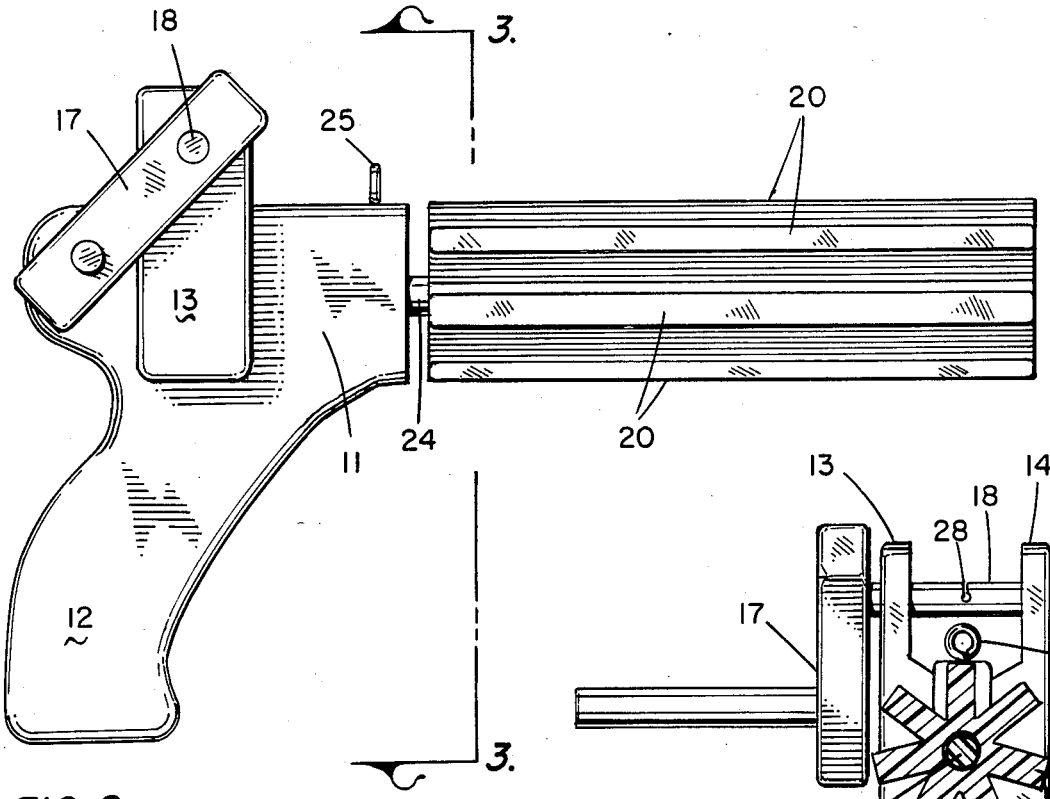
FIG. 2 is a side elevational view of the invention.

FIG. 2 illustrates a side elevational view of the repeating rubber band pistol 10 shown assembled but without any rubber bands or a string thereon.

Figure 3:
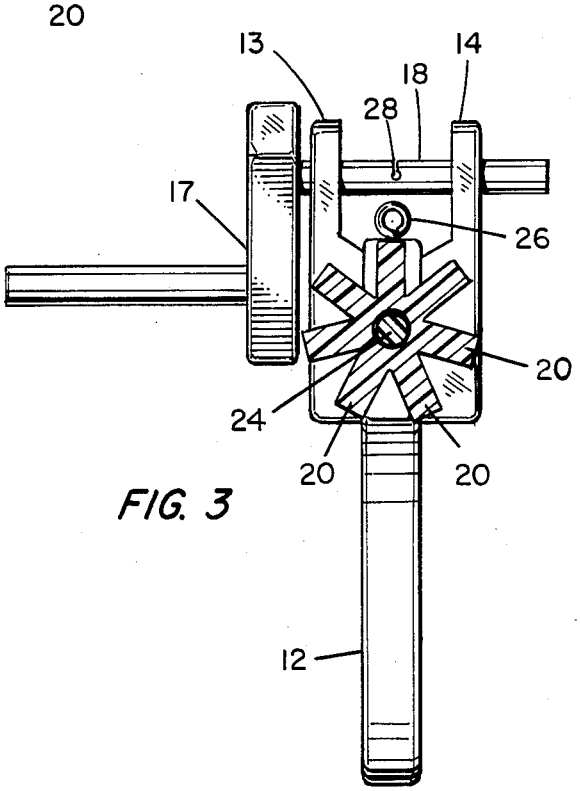
FIG. 3 is a view of the present invention taken along Plane 3—3 of FIG. 2.

FIG. 3 is a view taken along Plane 3—3 of FIG. 2 showing the relationship of the magazine 19 mounted on the spindle 24 via its own centrally-arranged spindle member 21.

LOADING THE RUBBER BANDS ON THE MAGAZINE

Turning now to FIGS. 5, 6 and 7, there is shown and illustrated the sequence of how to load and install the rubber bands 27 on the magazine 19 with the string 25 so that the rubber bands 27, once loaded, will be launchable from the magazine 19 following the mating of the magazine 19 with the spindle 24 mounted to the frame 11 of the pistol 10.

In FIG. 5 there is shown the magazine 19 with a plurality of radially-extending elongated arms 20 circumferencially mounted about the spindle member 21. As previously noted, the spindle member 21 has an centrally-disposed aperture therein. As depicted, the initial rubber band 27 is threaded through a loop in the end of the string 25 and arranged mediately of the magazine 19 prepatory to installation thereon.

The next step is shown in FIG. 6 which illustrates the rubber band 27 stretched over the extremities of the arm 20 and the mediate portion of which remains captured in the loop formed by the string 25. This first rubber band 27 acts as an anchor for the string 25.

The further step involves the addition of numerous additional rubber bands 27 in sequence over each of the arms 20 as detailed and shown in FIG. 7. As each rubber band 27 is stretched over the adjacent arm 20, the string 25 is threaded underneath the stretched rubber band 27. The arms 20 are radially extending to accomodate a substantial number of rubber bands 27 which are layered one over the other as the string 25 is passed under each layer.

Once the hundred or so rubber bands 23 are properly "loaded" onto the magazine 19 as described above, the magazine 19 is slipped over the spindle 24 mounted on the frame 11 of the pistol 10. The free end of the string 25 is passed through the eyelet 25 and threaded through a hole 28 in the spindle 18 of the hand crank 17 and secured thereto. The repeating rubber band pistol 10 is now ready for action.

OPERATION OF THE INVENTION

Once the repeating rubber band pistol 10 is assembled as illustrated in FIG. 1, it is ready to be fired.

The user grips the handle 12 of the pistol frame 11 with one hand, and turns the hand crank 17 with the other hand. As the hand crank is turned, the string 25 is wound about the spindle 18 of the hand crank 17. This causes the string 25 to be pulled through eyelet 26 and lifts the rubber band 23 towards the outermost edge of the arm 20. Once the rubber band is pulled outwardly by the string in this manner, the end of the stretched rubber band 23 nearest the pistol frame 11 is caused to be disengaged from the end of the arm 20 nearest the pistol frame 11. When this occurs, the rubber band 23 is launched or "shot" away from the pistol 10.

As the hand crank continues to be operated by the user, as the string 25 is gathered and wound up on the spindle 18, each rubber band 23, in turn, is shot from the gun in repeating, rapid fashion.

From the foregoing it will be readily apparent that a rubber band shooting gun constructed in accordance with the present invention may be made to carry any desired number of bands 23 by simply increasing the depth of the arms 20 and the parts associated therewith or by increasing the length of the string 25. With a gun of the character herein set forth the full capacity of bands may be shot without giving any attention to the gun other than to manually turn the hand crank as previously discussed.

Obviously many modifications and variations may be made to the pistol without departing from the spirit and concept of this invention and the use of mechanical equivalents is contemplated within the purpose of the appended claims.

What is claimed is:

1. A repeating rubber band gun for shooting elastic bands and the like, comprising:

(a) pistol frame means;

(b) a cylindrical magazine upon which the rubber bands are stretched and operably mounted for the purpose of holding said rubber bands in readiness for shooting, said magazine having a plurality of radially-extending elongated arms disposed circumferencially about the central longitudinal axis of said magazine said magazine having a central aperture extending along said longitudinal axis;

(c) a spindle means mounted on and forwardly of said pistol frame means, said spindle means supporting said magazine for rotation about said longitudinal axis;

(d) string means having one of its ends attached to said magazine at a point remote from said frame means and its other end extending rearward towards said frame means;

(e) hand crank means attached to said frame means and to said other end of said string means for tensioning said string means when said hand crank is operated, said string means being positioned on said magazine such that said rubber bands are stretched on said arms and when said string means is tensioned said magazine will rotate and said string lifts each of the plurality of rubber bands from its particular mounted position causing each one to be individually, and sequentially released and shot away from the gun in rapid fashion.

2. The repeating rubber band gun of claim 1 wherein said spindle includes an aperture therethrough whereby the string means is operably secured to the spindle by passing the string means through the aperture and tying it about said spindle.

3. The repeating rubber band gun of claim 1 wherein said hand crank is supported on said frame by support means, said support means includes:

(a) a first support arm operably mounted to the pistol frame and extending upwardly therefrom, said support arm having an aperture therein;

(b) a second support arm operably mounted to the pistol frame in complementary, spaced-apart relationship to said first support arm and having an aperture therein, said aperture being disposed in complementary opposition to said aperture in the first support arm, and a spindle operably mounted within the holes of the support arms, at least one end of said spindle extending through the aperture in one of said suport arms, said hand crank being secured to said one end to therefore effect rotation of said spindle, said other end of said string being attached to said hand crank spindle.

* * * * *